US010480509B2

(12) United States Patent
Murakami et al.

(10) Patent No.: US 10,480,509 B2
(45) Date of Patent: Nov. 19, 2019

(54) SCROLL-TYPE COMPRESSOR WITH OIL GROOVES ON SCROLL SLIDING SURFACES

(71) Applicant: DAIKIN INDUSTRIES, LTD., Osaka-shi, Osaka (JP)

(72) Inventors: Yasuhiro Murakami, Osaka (JP); Yasuo Mizushima, Osaka (JP); Ryouta Nakai, Osaka (JP); Katsumi Katou, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 184 days.

(21) Appl. No.: 15/553,122

(22) PCT Filed: Feb. 16, 2016

(86) PCT No.: PCT/JP2016/000800
§ 371 (c)(1),
(2) Date: Aug. 23, 2017

(87) PCT Pub. No.: WO2016/136185
PCT Pub. Date: Sep. 1, 2016

(65) Prior Publication Data

US 2018/0051697 A1 Feb. 22, 2018

(30) Foreign Application Priority Data

Feb. 27, 2015 (JP) ..... 2015-039345

(51) Int. Cl.
*F04C 18/02* (2006.01)
*F04C 15/00* (2006.01)
(Continued)

(52) U.S. Cl.
CPC ..... *F04C 18/0215* (2013.01); *F04C 15/0088* (2013.01); *F04C 18/02* (2013.01);
(Continued)

(58) Field of Classification Search
CPC .. F04C 18/0215; F04C 18/02; F04C 18/0253; F04C 29/0057; F04C 29/02; F04C 29/028; F04C 29/023
(Continued)

(56) References Cited

U.S. PATENT DOCUMENTS

2006/0216182 A1* 9/2006 Kohsokabe ..... F04C 29/026 418/55.6
2013/0209303 A1* 8/2013 Tsuka ..... F04C 18/0215 418/55.1
2014/0010694 A1 1/2014 Tsuka et al.

FOREIGN PATENT DOCUMENTS

JP 2012-77616 A1 4/2012
JP 2012-202221 A 10/2012

OTHER PUBLICATIONS

International Preliminary Report of corresponding PCT Application No. PCT/JP2016/000800 dated Sep. 8, 2017.
(Continued)

*Primary Examiner* — Deming Wan
(74) *Attorney, Agent, or Firm* — Global IP Counselors, LLP

(57) ABSTRACT

A scroll compressor includes a compression mechanism having fixed and movable scrolls to form a fluid chamber. The fixed scroll has an end plate, an outer peripheral wall, and a wrap. The movable scroll has an end plate and a wrap. A scroll oil groove is formed in a sliding contact surface of the outer peripheral wall. Lubricating oil having a high pressure corresponding to a discharge pressure of the compression mechanism is fed into the scroll oil groove. A scroll oil groove is formed in a sliding contact surface of the movable scroll, which slides on the outer peripheral wall. The fixed and movable scroll oil grooves communicate with each other without communicating with the fluid chamber in a first operation. The movable scroll oil groove simultane-
(Continued)

ously communicates with the fixed scroll oil groove and the fluid chamber in a second operation after the first operation.

16 Claims, 10 Drawing Sheets

(51) Int. Cl.
*F04C 29/00* (2006.01)
*F04C 29/02* (2006.01)
*F04C 23/00* (2006.01)

(52) U.S. Cl.
CPC ..... *F04C 18/0253* (2013.01); *F04C 23/008* (2013.01); *F04C 29/0057* (2013.01); *F04C 29/02* (2013.01); *F04C 29/028* (2013.01)

(58) Field of Classification Search
USPC ..... 418/55.1–55.5
See application file for complete search history.

(56) References Cited

OTHER PUBLICATIONS

International Search Report of corresponding PCT Application No. PCT/JP2016/000800 dated May 24, 2016.
European Search Report of corresponding EP Application No. 16 75 4938.5 dated Sep. 7, 2018.

* cited by examiner

SCROLL-TYPE COMPRESSOR WITH OIL GROOVES ON SCROLL SLIDING SURFACES

CROSS-REFERENCE TO RELATED APPLICATIONS

This U.S. National stage application claims priority under 35 U.S.C. § 119(a) to Japanese Patent Application No. 2015-039345, filed in Japan on Feb. 27, 2015, the entire contents of which are hereby incorporated herein by reference.

TECHNICAL FIELD

The present invention relates to a scroll compressor.

BACKGROUND ART

A scroll compressor has been known as an example of a compressor which compresses fluid.

Japanese Unexamined Patent Publication No. 2012-202221 discloses a scroll compressor of this kind. The scroll compressor includes a compression mechanism having a fixed scroll and a movable scroll. The fixed scroll includes a disc-shaped end plate, a cylindrical outer peripheral wall standing on an outer edge of the end plate, and a spiral wrap standing inside the outer peripheral wall. The movable scroll includes an end plate which is in sliding contact with tip ends of the outer peripheral wall and wrap of the fixed scroll, and a wrap standing on the end plate. The compression mechanism forms a compression chamber between the two wraps when the fixed and movable scrolls mesh with each other. The volume of the compression chamber gradually decreases when the movable scroll is rotating eccentrically about the fixed scroll. As a result, fluid in the compression chamber is compressed.

In this scroll compressor, an oil groove (fixed scroll's oil groove) is provided in an end face of the outer peripheral wall of the fixed scroll, and an oil groove (movable scroll's oil groove) provided in the end plate of the movable scroll. A high pressure lubricating oil is fed to the fixed scroll's oil groove. In the compression mechanism, the movable scroll rotates eccentrically, thereby alternately switching between a first state where the movable scroll's oil groove communicates with the fixed scroll's oil groove, and a second state where the movable scroll's oil groove communicates with a fluid chamber (compression chamber). When the compression mechanism is in the first state, high pressure lubricating oil is fed from the fixed scroll's oil groove to the movable scroll's oil groove. The oil is used to lubricate a thrust surface of the outer peripheral wall of the fixed scroll and a thrust surface of the end plate of the movable scroll. When the compression mechanism is in the second state, high pressure lubricating oil is fed from the movable scroll's oil groove to the fluid chamber. This facilitates the lubrication of sliding portions of the wraps of the fixed and movable scrolls. In addition, a gap between the sliding portions is effectively sealed, thereby improving the compression efficiency.

SUMMARY

Technical Problem

The compression mechanism disclosed by Japanese Unexamined Patent Publication No. 2012-202221 feeds high pressure lubricating oil to the movable scroll's oil groove in the first state, and to the compression chamber in the second state. However, when the movable scroll's oil groove and the fluid chamber communicate with each other in the second state, the internal pressures of the movable scroll's oil groove and the fluid chamber quickly approach each other. Consequently, the difference between the internal pressure of the movable scroll's oil groove and the internal pressure of the fluid chamber decreases, which may result in insufficient feeding of the lubricating oil from the movable scroll's oil groove to the fluid chamber in the second state. In such a case, the amount of the lubricating oil fed to the fluid chamber becomes insufficient. As a result, portions of the fixed and movable scrolls which are in sliding contact with each other cannot be lubricated enough, and/or sealing a gap between the fixed and movable scrolls may be failed.

In view of the foregoing background, the present invention has been achieved. Regarding a compression mechanism which feeds high pressure lubricating oil from an oil groove provided in a fixed scroll to an oil groove provided in a movable scroll, the present invention allows the compression mechanism to feed the high pressure lubricating oil to a fluid chamber with reliability.

Solution to the Problem

A first aspect of the present disclosure is directed to a scroll compressor. The scroll compressor includes: a compression mechanism (40) which includes: a fixed scroll (60) having an end plate (61), an outer peripheral wall (63) standing on an outer edge of the end plate (61), and a wrap (62) standing inside the outer peripheral wall (63); and a movable scroll (70) having an end plate (71) which is in sliding contact with tip ends of the wrap (62) and outer peripheral wall (63) of the fixed scroll (60), and a wrap (72) standing on the end plate (71), the compression mechanism (40) being configured to form a fluid chamber (S) between the fixed scroll (60) and the movable scroll (70), wherein a fixed scroll's oil groove (80), to which lubricating oil having a high pressure corresponding to a discharge pressure of the compression mechanism (40) is fed, is provided in a sliding contact surface (A1) of the outer peripheral wall (63) of the fixed scroll (60) on which the end plate (71) of the movable scroll (70) slides, a movable scroll's oil groove (83) is provided in a sliding contact surface (A2) of the movable scroll (70) which slides on the outer peripheral wall (63) of the fixed scroll (60), and the compression mechanism (40) is configured to perform a first operation in which only the fixed scroll's oil groove (80) and the movable scroll's oil groove (83), among the fixed scroll's oil groove (80), the movable scroll's oil groove (83) and the fluid chamber (S), communicate with each other, and a second operation in which, after the first operation, the movable scroll's oil groove (83) simultaneously communicates with both of the fixed scroll's oil groove (80) and the fluid chamber (S).

According to the first aspect of the present disclosure, high pressure lubricating oil is fed to the fixed scroll's oil groove (80) of the fixed scroll (60). The lubricating oil is used to lubricate the sliding contact surface (A1) (may be referred to as a "thrust surface") of the outer peripheral wall of the fixed scroll (60) which is in sliding contact with the end plate of the movable scroll (70). When the movable scroll (70) is rotating eccentrically, the first operation is performed in which the movable scroll's oil groove (83) provided in the sliding contact surface (A2) (may be referred to as a "thrust surface") of the movable scroll (70) communicates with the fixed scroll's oil groove (80). In the first operation, the movable scroll's oil groove (83) does not communicate with the fluid chamber (S). Thus, the high pressure lubricating oil in the fixed scroll's oil groove (80) is fed to the movable scroll's oil groove (83) due to a pressure difference between these oil grooves.

Thus, the high pressure lubricating oil fed to the movable scroll's oil groove (83) is used to lubricate the thrust surface. That is, in the first operation, an area of the thrust surfaces lubricated by the lubricating oil increases.

When the movable scroll (70) further rotates eccentrically, the second operation in which the movable scroll's oil groove (83) communicates with the fluid chamber (S), and with the fixed scroll's oil groove (80) is performed. If the movable scroll's oil groove (83) communicates only with the fluid chamber (S), just as disclosed by Patent Document 1, the internal pressures of the movable scroll's oil groove (83) and the fluid chamber (S) immediately approach each other, and a sufficient amount of lubricating oil cannot be fed to the fluid chamber (S).

In contrast, in the second operation according to the present invention, the movable scroll's oil groove (83) also communicates with the fixed scroll's oil groove (80) in a high pressure atmosphere. Thus, a sufficient difference can be made between the internal pressure of the movable scroll's oil groove (83) or the fixed scroll's oil groove (80) and the internal pressure of the fluid chamber (S). Thus, the lubricating oil can be fed sufficiently to the fluid chamber (S).

A second aspect of the present disclosure is an embodiment of the first aspect of the present disclosure. According to the second aspect, the compression mechanism (40) is configured to perform, after the second operation, a third operation in which the movable scroll's oil groove (83) is blocked from the fluid chamber (S), and the fixed scroll's oil groove (80) and the movable scroll's oil groove (83) keep communicating with each other.

According to the second aspect of the present disclosure, when the movable scroll (70) further rotates eccentrically after the second operation, a third operation in which the movable scroll's oil groove (83) is blocked from the fluid chamber (S) is performed. If the movable scroll's oil groove (83) were immediately blocked from the fixed scroll's oil groove (80) after the second operation, the internal pressure of the movable scroll's oil groove (83) would also decrease immediately. Thus, the oil fed to the thrust surfaces from the movable scroll's oil groove (83) would be insufficient, and the area of the thrust surfaces lubricated would not increase.

However, in the third operation according to the present invention, the movable scroll's oil groove (83) and the fixed scroll's oil groove (80) keep communicating with each other even after a transition is made from the second operation to the third operation. Thus, the high pressure lubricating oil is appropriately fed into the movable scroll's oil groove (83). As a result, a sufficient amount of oil can be fed from the movable scroll's oil groove (83) to the thrust surfaces, thereby increasing the area of the thrust surfaces lubricated.

A third aspect of the present disclosure is an embodiment of the second aspect of the present disclosure. According to the third aspect, the compression mechanism (40) is configured to perform, after the third operation and before the first operation, a fourth operation in which the movable scroll's oil groove (83) is simultaneously blocked from both of the fixed scroll's oil groove (80) and the fluid chamber (S).

According to the third aspect of the present disclosure, the fourth operation is performed after the third operation and before the first operation. In the fourth operation, the movable scroll's oil groove (83) is blocked not only from the fluid chamber (S), but also from the fixed scroll's oil groove (80). Thus, the feeding of the oil from the fixed scroll's oil groove (80) to the movable scroll's oil groove (83) is suspended.

A fourth aspect of the present disclosure is an embodiment of any one of the first to third aspects of the present disclosure. According to the fourth aspect, the compression mechanism (40) is configured to divide the fluid chamber (S) into a suction chamber (S1) and a compression chamber (S2) with a contact (C), at which an inner peripheral surface of the outer peripheral wall (63) of the fixed scroll (60) is in contact with an outer peripheral surface of the wrap (72) of the movable scroll (70), interposed between the suction chamber (S1) and the compression chamber (S2), and the movable scroll's oil groove (83) simultaneously communicates with both of the fixed scroll's oil groove (80) and the suction chamber (S1) in the second operation.

According to the fourth aspect of the present disclosure, the movable scroll (70) rotates eccentrically, which allows the outer peripheral surface of the wrap (72) of the movable scroll (70) to substantially come into contact with the inner peripheral surface of the outer peripheral wall (63) of the fixed scroll (60) with a small gap left between these surfaces. Thus, in the compression mechanism (40), the fluid chamber (5) is divided into a suction chamber (S1) communicating with a suction port, and a compression chamber (S2) which does not communicate with the suction port and in which fluid is compressed.

In the second operation, the movable scroll's oil groove (83) simultaneously communicates with both of the fixed scroll's oil groove (80) and the suction chamber (S1). The suction chamber (S1) has a lower pressure than the compression chamber (S2). This creates a relatively large difference between the pressure of the movable scroll's oil groove (83) or the fixed scroll's oil groove (80) and the pressure of the suction chamber (S1). As a result, the lubricating oil in the movable scroll's oil groove (83) or the fixed scroll's oil groove (80) can be fed to the fluid chamber (5) (suction chamber (S1)) with more reliability.

A fifth aspect of the present disclosure is an embodiment of any one of the first to fourth aspects of the present disclosure. According to the fifth aspect, the movable scroll's oil groove (83) includes an arcuate groove (83*a*) which is substantially arc-shaped and extending along an inner peripheral surface of the outer peripheral wall (63) of the fixed scroll (60).

According to the fifth aspect of the present disclosure, the movable scroll's oil groove (83) extends substantially in the shape of an arc along the inner peripheral surface of the outer peripheral wall (63) of the fixed scroll (60). Thus, the area of the thrust surfaces lubricated by the lubricating oil fed from the movable scroll's oil groove (83) to the thrust surfaces can be increased in the circumferential direction of the compression mechanism (40).

A sixth aspect of the present disclosure is an embodiment of the fifth aspect of the present disclosure. According to the sixth aspect, the compression mechanism (40) is configured to divide the fluid chamber (S) into a suction chamber (S1) and a compression chamber (52) with a contact (C), at which an outer peripheral end of the wrap (72) of the movable scroll (70) is in contact with an inner peripheral surface of the outer peripheral wall (63) of the fixed scroll (60), interposed between the suction chamber (S1) and the compression chamber (52) when the wrap (72) of the movable scroll (70) comes to a predetermined eccentric angular position, and a portion of the arcuate groove (83*a*) of the movable scroll's oil groove (83) is adjacent to the contact (C) of the outer peripheral end of the wrap (72) of the movable scroll (70) when the movable scroll (70) is at the eccentric angular position.

According to the sixth aspect of the present disclosure, when the wrap (72) of the movable scroll (70) is at the predetermined eccentric angular position, the outer peripheral end of the movable scroll (70) is substantially in contact with the inner peripheral surface of the outer peripheral wall (63) of the fixed scroll (60) with a small gap left between the outer peripheral end and the inner peripheral surface. Thus, the contact (C) is provided at the outer peripheral end of the wrap (72) of the movable scroll (70). At the outer peripheral end of the wrap (72) of the movable scroll (70), the compression efficiency may be lowered due to leakage of fluid.

According to the present embodiment, however, a portion of the arcuate groove (83*a*) of the movable scroll's oil groove (83) is adjacent to the contact (C). Thus, the oil that has flowed from the movable scroll's oil groove (83) onto the thrust surfaces is fed to the contact (C) to seal a gap, thereby reducing the leakage. This may prevent the drop of the compression efficiency due to leakage of fluid.

A seventh aspect of the present disclosure is an embodiment of the fifth or sixth aspect of the present disclosure. According to the seventh aspect, the compression mechanism (40) includes a key groove (46*b*) which is provided in the movable scroll (70) and into which a key (46*a*) of an Oldham coupling (46) fits, and a portion of the arcuate groove (83*a*) of the movable scroll's oil groove (83) is adjacent to a rear side of the key groove (46*b*) when at least the movable scroll (70) is at a predetermined eccentric angular position.

According to the seventh aspect of the present disclosure, a portion of the arcuate groove (83*a*) of the movable scroll's oil groove (83) is adjacent to the rear side of the key groove (46*b*) into which the key (46*a*) of the Oldham coupling (46) fits. Thus, the oil that has flowed from the movable scroll's oil groove (83) onto the thrust surfaces can also be fed to the key groove (46*b*), thereby lubricating a portion of the key (46*a*) sliding in the key groove (46*b*).

An eighth aspect of the present disclosure is an embodiment of any one of the fifth to seventh aspects of the present disclosure. According to the eighth aspect, the movable scroll's oil groove (83) includes a communicating groove (83*b*) extending from the arcuate groove (83*a*) toward the center of the movable scroll (70) and communicates with the fluid chamber (S) in the second operation.

According to the eighth aspect of the present disclosure, the movable scroll's oil groove (83) includes the arcuate groove 83*a*), and the communicating groove (83*b*) extending from the arcuate groove (83*a*) toward the center of the movable scroll (70). In the second operation, the movable scroll's oil groove (83) communicates with the fixed scroll's oil groove (80), and the communicating groove (83*b*) of the movable scroll's oil groove (83) communicates with the fluid chamber (S). Thus, the high pressure lubricating oil in the movable scroll's oil groove (83) or the fixed scroll's oil groove (80) flows through the communicating groove (83*b*) into the fluid chamber (S).

For example, when the communicating groove (83*b*) extended obliquely or perpendicular to the direction toward the center of the movable scroll (70), the area of the communicating groove (83*b*) overlapping with the fluid chamber (S) would significantly vary depending on the position of the movable scroll (70) rotating eccentrically in the second operation. In such a case, a constant amount of oil cannot be fed stably from the communicating groove (83*b*) to the fluid chamber (S), and the amount of oil discharged and the compression efficiency may vary.

In contrast, according to the present invention, the communicating groove (83*b*) extends in the direction toward the center of the movable scroll (70). Thus, in the second operation, the area of the communicating groove (83*b*) overlapping with the fluid chamber (S) does not significantly vary depending on the position of the movable scroll (70) rotating eccentrically. Consequently, a constant amount of oil can be fed stably from the communicating groove (83*b*) to the fluid chamber (S), thereby improving the compression efficiency, and substantially preventing the oil from being discharged outside.

Advantages of the Invention

According to the first aspect of the present disclosure, in the second operation, the movable scroll's oil groove (83) communicates with both of the fluid chamber (S) and the fixed scroll's oil groove (80). Thus, a sufficient difference can be made between the internal pressure of the movable scroll's oil groove (83) and the internal pressure of the fluid chamber (S). As a result, the lubricating oil in the movable scroll's oil groove (83) or the fixed scroll's oil groove (80) can be fed to the fluid chamber (S) with reliability, thereby further lubricating various sliding portions, and effectively sealing various portions to be sealed.

According to the second aspect of the present disclosure, the movable scroll's oil groove (83) and the fixed scroll's oil groove (80) keep communicating with each other even in the third operation after the second operation. Thus, the internal pressure of the movable scroll's oil groove (83) may effectively be prevented from decreasing, and the movable scroll's oil groove (83) can be replenished with the high pressure lubricating oil fed from the fixed scroll's oil groove (80). As a result, the area of the thrust surfaces lubricated by the lubricating oil fed from the fixed scroll's oil groove (80) and the movable scroll's oil groove (83) is increased with reliability.

According to the third aspect of the present disclosure, the movable scroll's oil groove (83) is blocked from the fixed scroll's oil groove (80) in the fourth operation performed between the third and first operations. Thus, the feeding of the lubricating oil from the fixed scroll's oil groove (80) to the movable scroll's oil groove (83) can be suspended intermittently. Thus, excessive feeding of the lubricating oil to the movable scroll's oil groove (83) may be prevented, thereby avoiding lack of the lubricating oil fed to the other sliding portions (i.e., avoiding oil from being discharged outside).

According to the fourth aspect of the present disclosure, the movable scroll's oil groove (83) and the suction chamber (S1) communicate with each other in the second operation. Thus, a large difference between the pressure of the movable scroll's oil groove (83) and the pressure of the suction chamber (S1) can be maintained, thereby increasing the amount of the lubricating oil fed from the movable scroll's oil groove (83) to the suction chamber (5).

According to the fifth aspect of the present disclosure, the movable scroll's oil groove (83) is arc-shaped. Thus, the area of the thrust surfaces lubricated can further be increased. In particular, according to the sixth aspect of the present disclosure, the oil in the arcuate groove (83*a*) may also be fed to the contact (C) at the outer peripheral end of the movable scroll (70). Thus, a portion around the contact (C) may be lubricated and sealed more effectively. Further, according to the seventh aspect of the present disclosure, the oil in the arcuate groove (83*a*) may also be fed to the key groove (46*b*) into which the key (46*a*) of the Oldham coupling (46) fits. Thus, a portion around the key groove (46*b*) may be lubricated more effectively.

According to the eighth aspect of the present disclosure, in the second operation, a constant amount of oil can be fed stably from the communicating groove (83*b*) of the movable scroll's oil groove (83) to the fluid chamber (S). In the second operation, the amount of oil fed from the movable scroll's oil groove (83) to the fluid chamber (S) is generally determined based on the height of the communicating groove (83*b*) in the axial direction of the compression mechanism (40) and the width of the communicating groove (83*b*) in the circumferential direction. This reduces the number of parameters of the communicating groove (83*b*) on which the determination of the amount of the oil fed depends, thereby reducing fluctuation in amount of the oil, improving the compression efficiency, and substantially preventing the oil from being discharged outside.

DESCRIPTION OF EMBODIMENTS

Embodiments of the present invention will now be described in detail with reference to the drawings. The following embodiments are rely exemplary ones in nature, and do not intend to limit the scope, applications, or use of the invention.

Figure 1:
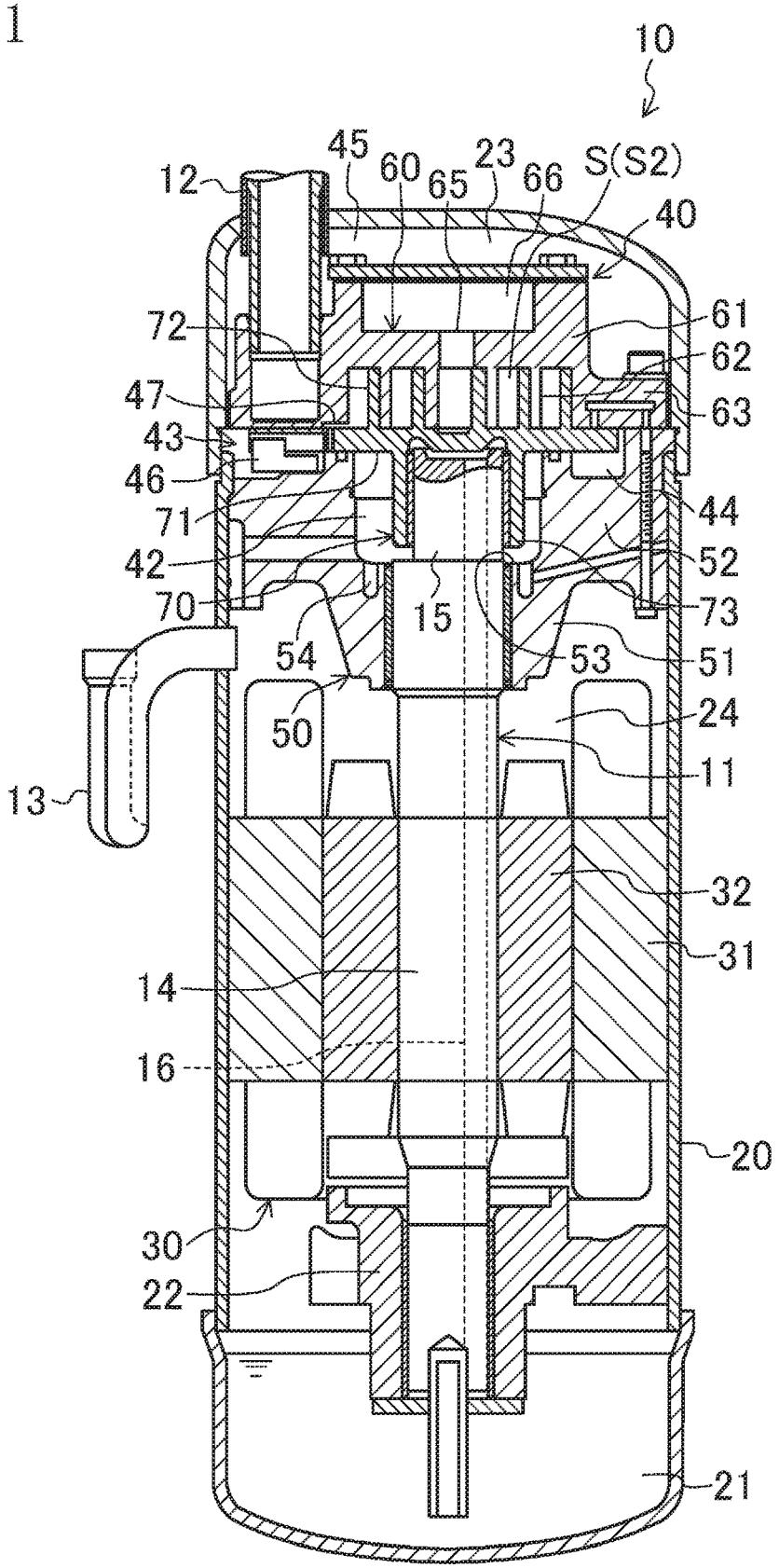
FIG. 1 is a vertical cross-sectional view of a scroll compressor according to an embodiment.
Figure 2:
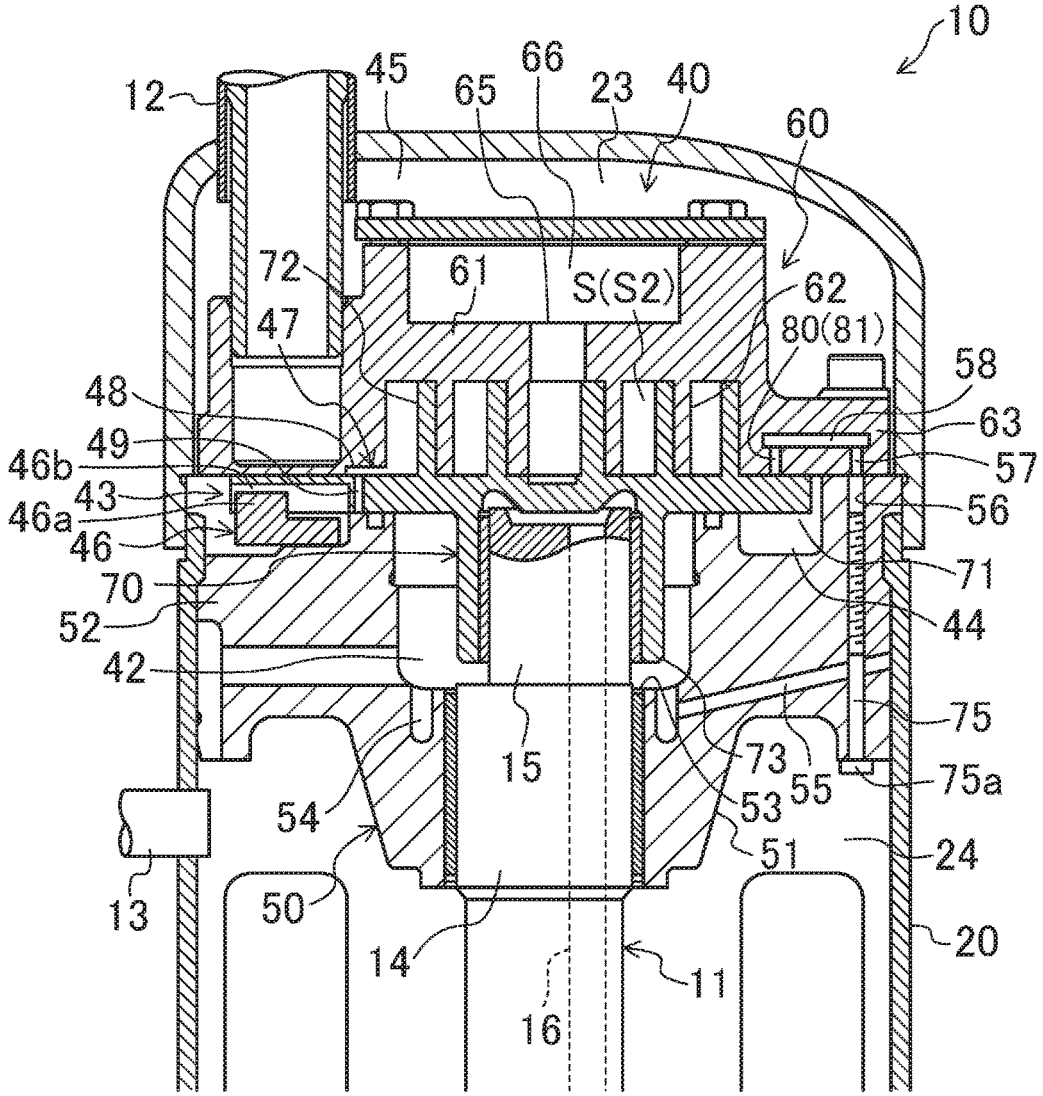
FIG. 2 is a vertical cross-sectional view of a major part of the scroll compressor according to the embodiment.

As shown in FIGS. 1 and 2, a scroll compressor (10) according to this embodiment (hereinafter simply referred to as a "compressor (10)") is provided in a refrigerant circuit which performs a vapor compression refrigeration cycle, and compresses a refrigerant which is fluid. In the refrigerant circuit, a refrigerant compressed in the compressor (10) is condensed in a condenser, decompressed in a decompression mechanism, evaporates in an evaporator, and is sucked into the compressor (10).

The scroll compressor (10) includes a casing (20), in which a motor (30) and a compression mechanism (40) are housed. The casing (20) has the shape of a vertical cylinder, and is configured as a hermetic dome.

The motor (30) includes a stator (31) fixed to the casing (20), and a rotator (32) arranged inside the stator (31). The rotator (32) is fixed to a drive shaft (11) which penetrates the rotator (32).

An oil sump (21) which stores lubricating oil is provided at the bottom of the casing (20). A suction pipe (12) penetrates an upper portion of the casing (20). A discharge pipe (13) penetrates a center portion of the casing (20).

A housing (50) arranged above the motor (30) is fixed to the casing (20). A compression mechanism (40) is arranged above the housing (50). An inlet end of the discharge pipe (13) is located between the motor (30) and the housing (50).

The drive shaft (11) extends vertically along a center axis of the casing (20). The drive shaft (11) includes a main shaft (14), and an eccentric portion (13) coupled to an upper end of the main shaft (14). A lower portion of the main shaft (14) is rotatably supported by a lower bearing (22). The lower bearing (22) is fixed to an inner peripheral surface of the casing (20). An upper portion of the main shaft (14) penetrates the housing (50), and is rotatably supported by an upper bearing (51) of the housing (50). The upper bearing (51) is fixed to the inner peripheral surface of the casing (20).

The compression mechanism (40) includes a fixed scroll (60) fixed to an upper surface of the housing (50), and a movable scroll (70) which meshes with the fixed scroll (60). Specifically, the movable scroll (70) is arranged on the housing (30) to be located between the fixed scroll (60) and the housing (50).

The housing (50) includes an annular portion (52) and a recess (53). The annular portion (52) constitutes an outer peripheral portion of the housing (50). The recess (53) is formed in an upper center portion of the housing (50), and has a dished center portion. The upper bearing (51) is formed under the recess (53).

The housing (50) is press-fitted in, and fixed to, the casing (20). That is, an outer peripheral surface of the annular portion (52) of the housing (50) is brought into close contact with an inner peripheral surface of the casing (20) in an airtight manner throughout its circumference. The housing (50) divides a space inside the casing (20) into an upper space (23) housing the compression mechanism (40) and a lower space (24) housing the motor (30).

The fixed scroll (60) includes an end plate (61), a substantially cylindrical, outer peripheral wall standing on an outer edge of a front surface (a surface facing down in FIGS. 1 and 2) of the end plate (61), and a spiral (involute) wrap (62) standing inside the outer peripheral wall (63) on the end plate (61). The end plate (61) is located outside in an outer peripheral direction and continuous with the wrap (62). A tip end face of the wrap (62) and a tip end face of the outer peripheral wall (63) are substantially flush with each other. Further, the fixed scroll (60) is fixed to the housing (50).

The movable scroll (70) includes an end plate (71), a spiral (involute) wrap (72) formed on a front surface (a surface facing up in FIGS. 1 and 2) of the end plate (71), and a boss (73) formed on a center portion of a rear surface of the end plate (71). The boss (73) receives the eccentric portion (15) of the drive shaft (11) inserted therein, and thus, is coupled with the drive shaft (11).

The compression mechanism (40) forms, between the fixed scroll (60) and the movable scroll (70), a fluid chamber (S) into which a refrigerant flows. The movable scroll (70) is arranged such that the wrap (72) meshes with the wrap (62) of the fixed scroll (60). A suction port (64) is formed through the outer peripheral wall (63) of the fixed scroll (60) (see FIG. 3). A downstream end of the suction pipe (12) is connected to the suction port (64).

The fluid chamber (S) is divided into a suction chamber (S1) and a compression chamber (S2). Specifically, when an inner peripheral surface of the outer peripheral wall (63) of the fixed scroll (60) is substantially in contact with an outer peripheral surface of the wrap (72) of the movable scroll (70), the suction chamber (S1) and the compression chamber (S2) are formed with a contact (C) interposed between these chambers (see, e.g., FIG. 3). The suction chamber (S1) constitutes a space into which a low pressure refrigerant is introduced. The suction chamber (S1) communicates with the suction port (64), and is blocked from the compression chamber (S2). The compression chamber (S2) constitutes a space in which a low pressure refrigerant is compressed. The compression chamber (S2) is blocked from the suction chamber (S1).

A discharge port (65) is formed to penetrate the center of the end plate (61) of the fixed scroll (60). A high pressure chamber (66) in which the discharge port (65) opens is formed on a rear surface (a surface facing up in FIGS. 1 and 2) of the end plate (61) of the fixed scroll (60). The high pressure chamber (66) communicates with the lower space (24) via a passage (not shown) formed through the end plate (61) of the fixed scroll (60) and the housing (50). A high pressure refrigerant compressed in the compression mechanism (40) flows into the lower space (24). Consequently, the lower space (24) of the casing (20) is in a high pressure atmosphere.

An oil feeding passage (16) vertically extends inside the drive shaft (11) from a lower end to upper end of the drive shaft (11). The lower end of the drive shaft (dipped in lubricating oil in the oil sump (21). The oil feeding passage (16) feeds the lubricating oil in the oil sump (21) to the lower and upper bearings (22) and (51), and to a surface of the boss (73) and a surface of the drive shaft (11) sliding on each other. The oil feeding passage (16) opens at an upper end face of the drive shaft (11) so as to feed the lubricating oil to the upper portion of the drive shaft (11).

A sealing member (not show is a angel on an upper surface of an inner peripheral portion of the annular portion (52) of the housing (50). A back pressure region (42), which is a high pressure space, is formed radially inside the sealing member. An intermediate pressure region (43), which is an intermediate pressure space, is formed radially outside the sealing member. That is, the back pressure region (42) is mainly comprised of the recess (53) of the housing (50). The recess (53) communicates through the inside of the boss (73) of the movable scroll (70) with the oil feeding passage (16) in the drive shaft (11). A high pressure corresponding to a discharge pressure of the compression mechanism (40) acts on the hack pressure region (42). The high pressure acted on the back pressure region (42) presses the movable scroll (70) onto the fixed scroll (60).

The intermediate pressure region (43) includes a pressurizing region (44) adjacent to the movable scroll and a pressurizing region (45) adjacent to the fixed scroll. The pressurizing region (44) adjacent to the movable scroll is provided on the rear surface of the end plate (71) of the movable scroll (70) to be adjacent to the outer periphery of the end plate (71). The pressurizing region (44) adjacent to the movable scroll is provided radially outside the back pressure region (42), and presses the movable scroll (70) toward the fixed scroll (60) with the intermediate pressure.

The pressurizing region (45) adjacent to the fixed scroll is formed in the upper space (23) to be closer to the outside than the fixed scroll (60). The pressurizing region (45) adjacent to the fixed scroll communicates with the pressurizing region (44) adjacent to the movable scroll through a gap between the outer peripheral wall (63) of the end plate (61) of the fixed scroll (60) and the casing (20).

An Oldham coupling (46) is provided on the housing (50). The Oldham coupling (46) is configured as a rotation inhibitor which inhibits the movable scroll (70) from rotating about its own axis. The Oldham coupling (46) is provided with a horizontally oriented key (46*a*) protruding toward the rear surface of the end plate (71) of the movable scroll (70) (see FIGS. 2 and 3). On the other hand, a key groove (46*b*) in which the key (46*a*) of the Oldham coupling (46) fits in a slidable manner is formed in the rear surface of the end plate (71) of the movable scroll (70).

As illustrated in FIG. 2, the housing (50) is provided with an elastic groove (54), a first oil passage (55), and a second oil passage (56). The elastic groove (54) is formed at bottom of the recess (53). The elastic groove (54) is an annular groove surrounding the drive shaft (11). The elastic groove (54) communicates with an inlet end of the first oil passage (55). The first oil passage extends obliquely upward in the housing (50) in a direction from the inner perimeter to outer perimeter of the housing (50). An inlet end of the second oil passage (56) opens at a portion of the first oil passage (55) adjacent to the outer perimeter of the housing. The second oil passage (56) penetrates the housing (50) vertically from top to bottom. A screw member (75) is inserted into a lower end of the second oil passage (56). The lower end of the second oil passage (56) is blocked with a head (75*a*) of the screw member (75).

A third oil passage (57), a fourth oil passage (58), and a vertical hole (81) are formed through the outer peripheral wall (63) of the fixed scroll (60). An inlet end (lower end) of the third oil passage (57) communicates with an outlet end (upper end) of the second oil passage (56). The third oil passage (57) extends vertically within the outer peripheral wall (63). An inlet end (outer end) of the fourth oil passage (58) communicates with an outlet end (upper end) of the third oil passage (57). The fourth oil passage (58) extends radially within the outer peripheral wall (63) of the fixed scroll (60). An inlet end (upper end) of the vertical hole (81) communicates with an outlet end (inner end) of the fourth oil passage (58). The vertical hole (81) extends downward from the inlet end toward the end plate (71) of the movable scroll (70). An outlet end of the vertical hole (81) opens at a surface of the outer peripheral wall (63) of the fixed scroll (60) sliding on the end plate (71) of the movable scroll (70). That is, high pressure lubricating oil in the recess (53) is fed through the vertical hole (81) to a sliding contact surface (A1) of the outer peripheral wall (63) of the fixed scroll (60) and a sliding contact surface (A2) of the end plate (71) of the movable scroll (70) which are in sliding contact with each other.

Figure 3:
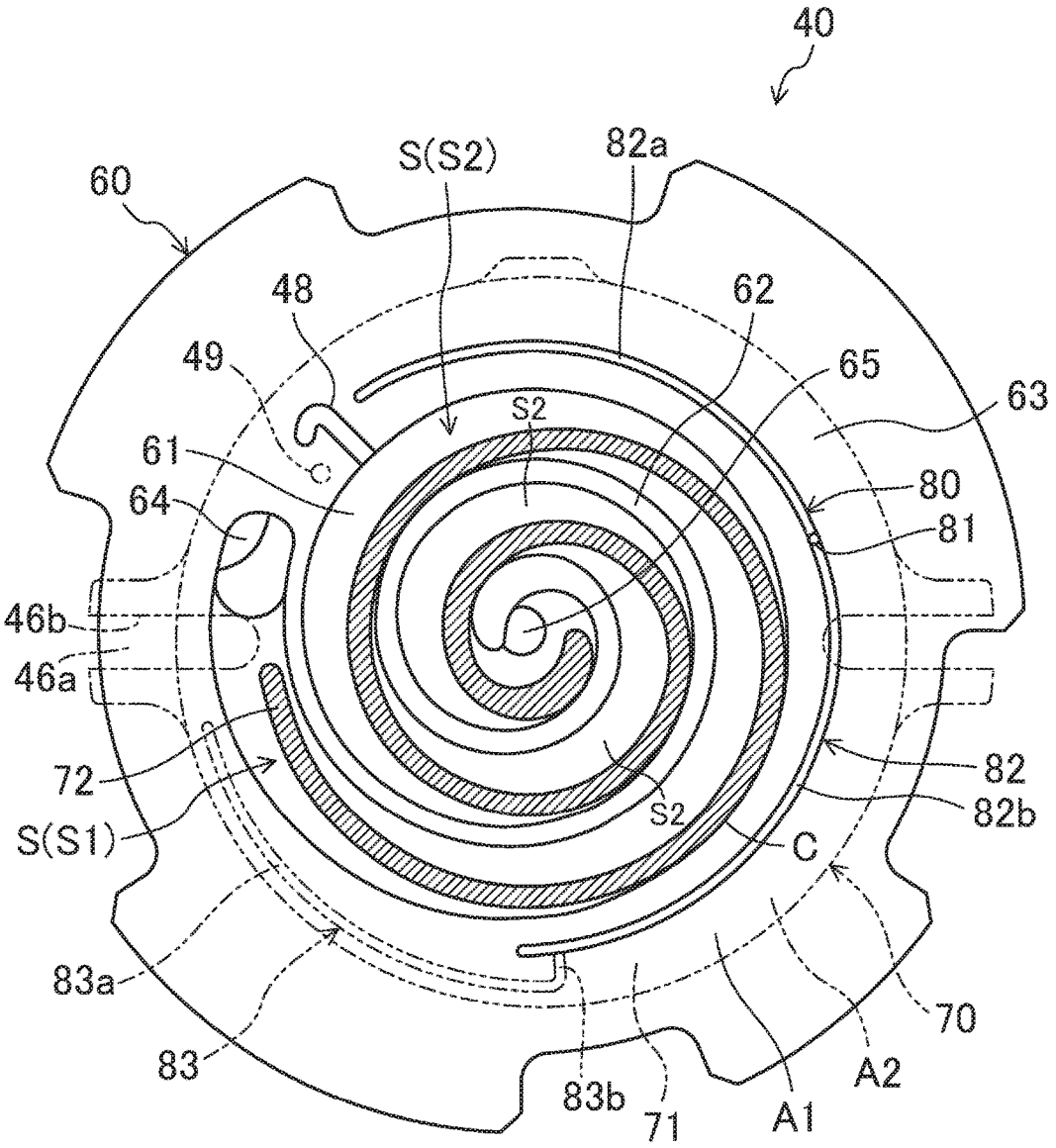
FIG. 3 is a bottom view of a fixed scroll of the scroll compressor according to the embodiment, illustrating a state where the fixed scroll is at an eccentric angular position where a first operation is performed.

The fixed and movable scrolls (60) and (70) form a regulating groove (47) through which an intermediate pressure refrigerant is fed to the intermediate pressure region (43). As shown in FIGS. 2 and 3, the regulating groove (47) is comprised of a primary passage (48) formed in the fixed scroll (60), and a secondary passage (49) formed in the movable scroll (70). The primary passage (48) is formed in a bottom surface of the outer peripheral wall (63) of the fixed scroll (60). An inner end of the primary passage (48) opens in an inner peripheral surface of the outer peripheral wall (63), and communicates with the compression chamber (S) at an intermediate pressure.

The secondary passage (49) is configured as a through hole vertically penetrating an outer peripheral portion of the end plate (71) of the movable scroll (70). The secondary passage (49) is a circular hole having a round cross-sectional shape (a section cut in a direction perpendicular to the axis of the passage). However, the secondary passage (49) does not necessarily have the round cross-sectional shape, and may have an elliptical or arcuate cross-sectional shape.

The secondary passage (49) has an upper end intermittently communicating with an outer end of the primary passage (48), and a lower end communicating with the intermediate pressure region (43) between the movable scroll (70) and the housing (50). That is, an intermediate pressure refrigerant is intermittently fed from the compression chamber (41) at an intermediate pressure, thereby allowing the intermediate pressure region (43) to be in a predetermined intermediate pressure atmosphere.

<Configuration of Fixed Scroll's Oil Groove and Movable Scroll's Oil Groove>

As shown in HG 3, an oil groove (a fixed scroll's oil groove) (80) is formed in a front surface (a surface facing down in FIG. 2) of the outer peripheral wall (63) of the fixed scroll (60). Specifically, the fixed scroll's oil groove (80) is provided in a sliding contact surface (A1) (may be referred to as a "thrust surface") of the outer peripheral wall (63) of the fixed scroll (60) which is in sliding contact with the end plate (71) of the movable scroll (70). The fixed scroll's oil groove (80) includes the above-described vertical hole (81), and a circumferential groove (82) extending to pass the vertical hole (81).

The circumferential groove (82) substantially has the shape of an arc extending along an inner peripheral surface of the outer peripheral wall (63) of the fixed scroll (60). The circumferential groove (82) includes a first arcuate groove (82*a*) and a second arcuate groove (82*b*). The first arcuate groove (82*a*) extends from the vertical hole (81) toward one end (an end on the counterclockwise side of the vertical hole in FIG. 3). The second arcuate groove (82*b*) extends from the vertical hole (81) toward the other end (an end on the clockwise side of the vertical hole in FIG. 3). Each of the arc-shaped grooves (82*a*, 82*b*) extends in a range of about 90 degrees relative to the center of the movable scroll (70). A distance between the first arcuate groove (82*a*) and the inner peripheral surface of the outer peripheral wall (63) gradually increases toward the counterclockwise end of the first arcuate groove (82*a*). A distance between the second arcuate groove (82*b*) and the inner peripheral surface of the outer peripheral wall (63) gradually decreases toward the clockwise end of the second arcuate groove (82*b*).

As shown in FIG. 3, an oil groove (a movable scroll's oil groove) (83) is formed in an outer peripheral portion of a front surface (a surface facing up in FIG. 2) of the end plate (71) of the movable scroll (70). Specifically, the movable scroll's oil groove (83) is provided in a sliding contact surface (A2) (may be referred to as a "thrust surface") of the end plate (71) of the movable scroll (70) which is in sliding contact with the outer peripheral wall (63) of the fixed scroll (60). The movable scroll's oil groove (83) is formed adjacent to the end of the second arcuate groove (82*b*) of the fixed scroll (60). The movable scroll's oil groove (83) includes an arcuate groove (83*a*) which substantially has the shape of an arc, and a communicating groove (83*b*) continuous with one end (a counterclockwise end in FIG. 3) of the arcuate groove (83*a*).

The arcuate groove (83*a*) of the movable scroll's oil groove (83) substantially extends in the shape of an arc from a position adjacent to the end of the second arcuate groove (82*b*) along the outer peripheral surface of the end plate (71) of the movable scroll (70). The arcuate groove (83*a*) of the movable scroll of the present embodiment extends in a range of about 90 degrees. The arcuate groove (83*a*) of the movable scroll extends such that the other end thereof (a clockwise end in FIG. 3) is adjacent to the rear side of the key groove (46*b*). That is, a portion of the arcuate groove (83*a*) of the movable scroll is adjacent to the rear side of the key groove (46*b*).

Figure 6:
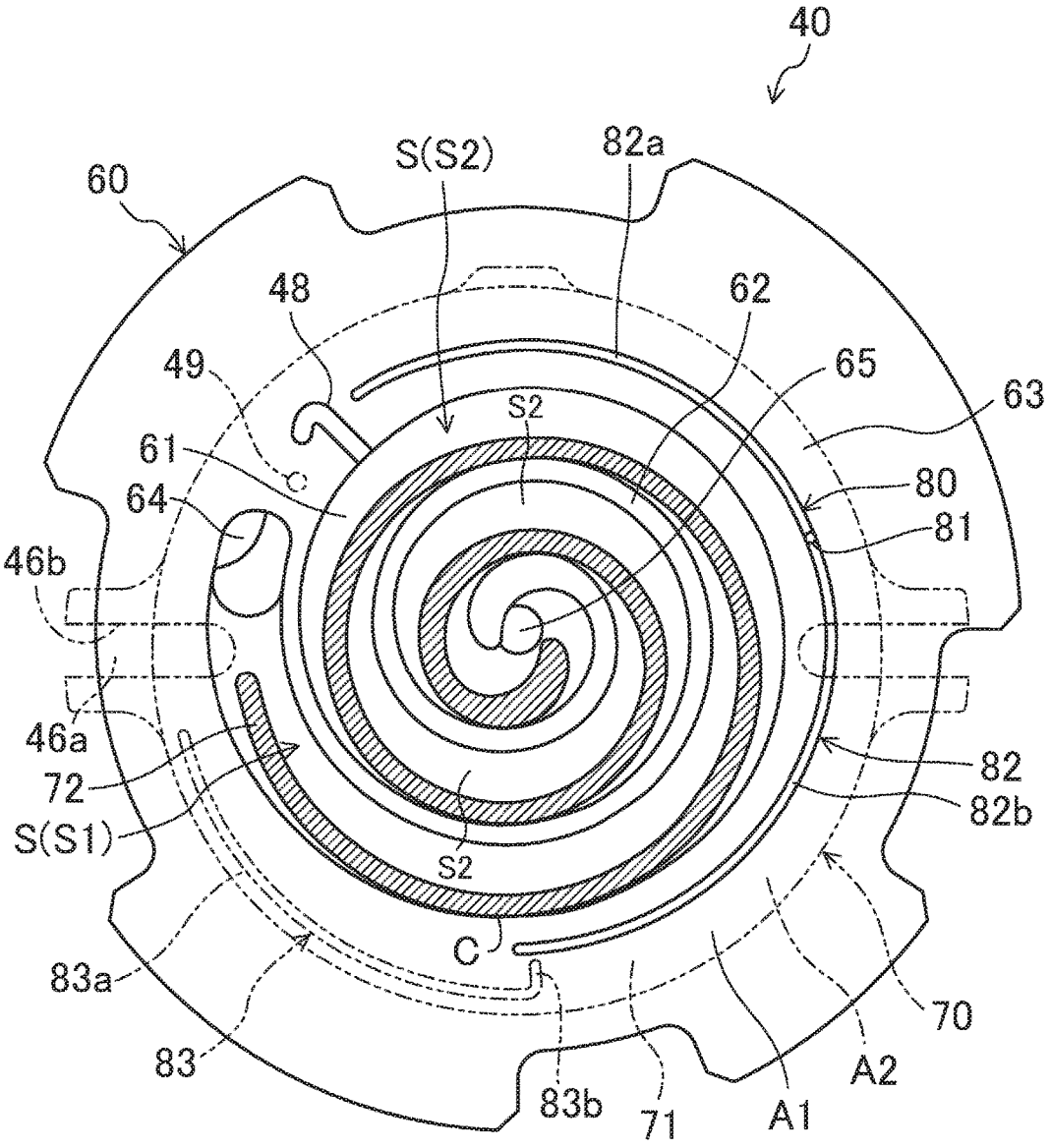
FIG. 6 is a bottom view of the fixed scroll of the scroll compressor according to the embodiment, illustrating a state where the fixed scroll is at an eccentric angular position where a fourth operation is performed.
Figure 7:
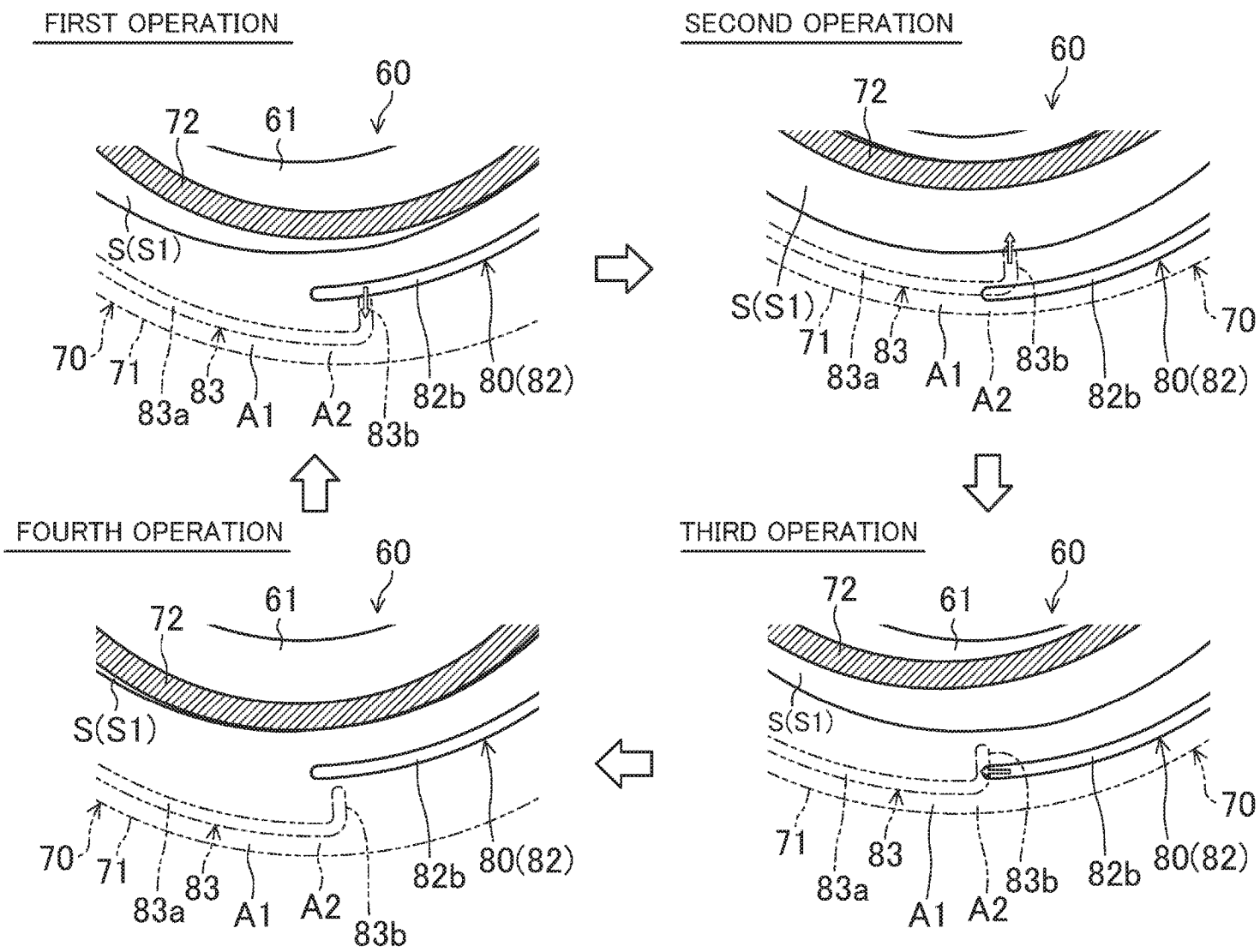
FIG. 7 is an enlarged bottom view illustrating a major part of the fixed scroll including a fixed scroll's oil groove, a movable scroll's oil groove, and a fluid chamber in first to fourth operations performed in this order.

The arcuate groove (83*a*) of the movable scroll of the present embodiment extends such that, when the wrap (72) of the movable scroll (70) is at an eccentric angular position where the wrap (72) is in contact with the inner peripheral surface of the outer peripheral wall (63) of the fixed scroll (60), the other end of the arcuate groove (83*a*) is adjacent to the point of contact (a contact (C)) (see FIG. 6). That is, the arcuate groove (83*a*) includes a portion located adjacent to the contact (C) when the movable scroll (70) is at the eccentric angular position shown in FIG.

The communicating groove (83*b*) extends to bend from the one end of the arcuate groove (83*a*) toward the center of the movable scroll (70). Specifically, the communicating groove (83*b*) extends in a radially inward direction in the end plate (71) of the movable scroll (70), and an inward end thereof can communicate with the fluid chamber (S). A vertical cross section of the communicating groove (83*b*) perpendicular to the extending direction of the communicating groove (83*b*) is substantially rectangular. The vertical cross-sectional shape of the communicating groove (83*b*) does not change from the one longitudinal end to the other. Thus, the number of parameters which need to be considered in designing the communicating groove (83*b*) is reduced, which facilitates the designing and working of the communicating groove (83*b*).

The movable scroll's oil groove (83) switches the state of communication with the fixed scroll's oil groove (80) and the fluid chamber (the suction chamber (S1) in this embodiment) as the movable scroll (70) rotates eccentrically. As a result, the compression mechanism (40) performs four different operations of feeding high pressure lubricating oil in the fixed scroll's oil groove (80) to predetermined sites. Specifically, the compression mechanism (40) repeats the four operations sequentially in the order of a first operation, a second operation, a third operation, a fourth operation, the first operation again, and the second operation again, while the movable scroll (70) rotates eccentrically.

—Operations—

First, a basic operation of the compressor (10) will be described below.

When the motor (30) is actuated, the movable scroll (70) of the compression mechanism (40) is driven in rotation. A rotation inhibitor (46) inhibits the movable scroll (70) from rotating about its own axis. Thus, the movable scroll (70) rotates only eccentrically about an axial center of the drive shaft (II). As shown in FIGS. 3-6, when the movable scroll (70) rotates eccentrically, the fluid chamber (S) is divided into the suction chamber (S1) and the compression chamber (S2) with the contact (C) interposed therebetween. The compression chamber (S2) includes a plurality of compression chambers (S2) between the wrap (62) of the fixed scroll (60) and the wrap (72) of the movable scroll (70). When the movable scroll (70) is rotating eccentrically, the compression chambers (S2) gradually approach the center (discharge port), with their volume gradually decreasing. As a result, a refrigerant is compressed in each compression chamber (S2).

When the compression chamber (S2), the volume of which has been minimized, communicates with the discharge port (65), a high pressure gas refrigerant in the compression chamber (S2) is discharged into the high pressure chamber (66) via the discharge port (65). The high pressure gas refrigerant in the high pressure chamber (66) flows into the lower space (24) via the various passages formed in the fixed scroll (60) and the housing (50). The high pressure gas refrigerant in the lower space (24) is discharged outside the casing (20) via the discharge pipe (13).

—Oil Feeding Operation—

Next, how the lubricating oil is fed within the compressor (10) will be described in detail with reference to FIGS. 2-7.

When the high pressure gas refrigerant flows into the lower space (24) of the compressor (10), a high pressure atmosphere is created in the lower space (24), and the lubricating oil in the oil sump (21) also turns to be high pressure lubricating oil. The high pressure lubricating oil in the oil sump (21) flows upward through the oil feeding passage (16) in the drive shaft (11), and flows through the upper opening of the eccentric portion (15) of the drive shaft (11) into the inside of the boss (73) of the movable scroll (70).

The oil fed to the boss (73) is fed onto the surface of the eccentric portion (15) of the drive shaft (11) and the surface of the boss (73) sliding on each other. Thus, a high pressure atmosphere corresponding to the discharge pressure of the compression mechanism (40) is created in the back pressure region (42). The high pressure acted on the back pressure region (42) presses the movable scroll (70) onto the fixed scroll (60).

The high pressure oil stored in the back pressure region (42) flows into the elastic groove (54), sequentially passes through the first, second, third, and fourth oil passages (55), (56), (57), and (58), and flows into the vertical hole (81). Thus, high pressure lubricating oil, the pressure of which corresponds to the discharge pressure of the compression mechanism (40), is fed to the fixed scroll's oil groove (80). In this state, when the movable scroll (70) rotates eccentrically, the first, second, third, and fourth operations are sequentially performed. In every operation, the oil in the circumferential groove (82) of the fixed scroll's oil groove (80) is used to lubricate the thrust surfaces (sliding contact surfaces A1, A2) around the groove (82).

<First Operation>

When the movable scroll (70) is at an eccentric angular position shown in FIG. 3, for example, the first operation is performed. In the first operation, the end of the second arcuate groove (82*b*) of the fixed scroll's oil groove (80) communicates with the one end (a radially inward end) of the communicating groove (83*b*) of the movable scroll's oil groove (83). Thus, the high pressure lubricating oil in the fixed scroll's oil groove (80) flows through the communicating groove (83*b*) into the movable scroll's oil groove (83) (see FIG. 7). As a result, the communicating groove (83*b*) and arcuate groove (83*a*) of the movable scroll's oil groove (83) are filled with the high pressure lubricating oil. In the first operation, the movable scroll's oil groove (83) is blocked from the suction chamber (S1). Thus, the high pressure lubricating oil in the movable scroll's oil groove (83) is used to lubricate the thrust surfaces (sliding contact surfaces (A1, A2)) around the groove (83).

The other end of the arcuate groove (83*a*) of the movable scroll's oil groove (83) is adjacent to the key groove (46*b*). Thus, part of the lubricating oil that has flowed from the arcuate groove (83*a*) to the thrust surfaces also flows into the key groove (46*b*). As a result, the key groove (46*b*) and the key (46*a*) of the Oldham coupling (46) are lubricated.

<Second Operation>

Figure 4:
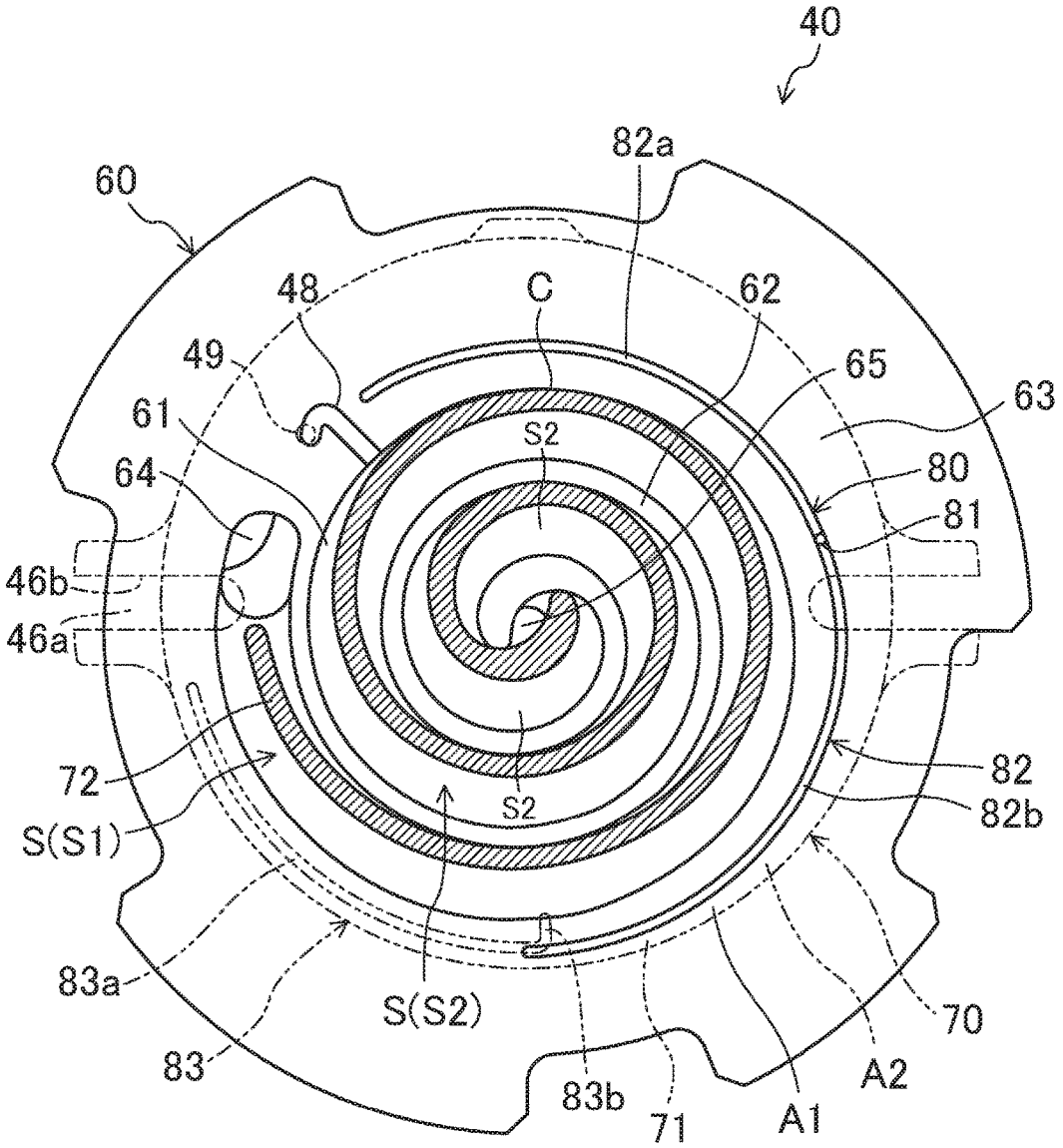
FIG. 4 is a bottom view of the fixed scroll of the scroll compressor according to the embodiment, illustrating a state where the fixed scroll is at an eccentric angular position where a second operation is performed.

When the movable scroll (70) at the eccentric angular position shown in FIG. 3 further rotates eccentrically to a different eccentric angular position shown in FIG. 4, for example, the second operation is performed. In the second operation, the end of the second arcuate groove (82*b*) of the fixed scroll's oil groove (80) communicates with the one end of the arcuate groove (83*a*) of the movable scroll's oil groove (83). Simultaneously, the one end of the communicating groove (83*b*) of the movable scroll's oil groove (83) communicates with the fluid chamber (the suction chamber (S1)).

Suppose that, in the second operation, the movable scroll's oil groove (83) communicates with the suction chamber (S1), and is blocked from the fixed scroll's oil groove (80). In such a state, the pressures of the movable scroll's oil groove (83) and the suction chamber (S1) immediately approach each other, which may possibly result in insufficient feeding of the lubricating oil to the suction chamber (S1). Consequently, the fluid chamber (5) lacks the lubricating oil, which leads to insufficient lubrication of various sliding portions, or poor sealing between the sliding portions.

In contrast, in the second operation according to this embodiment, the movable scroll's oil groove (83) communicates with both of the suction chamber (S1) and the fixed scroll's oil groove (80). This may prevent the drop of the internal pressure of the movable scroll's oil groove (83), and allow the fixed scroll's oil groove (80) to communicate through the communicating groove (83*b*) with the suction chamber (S1). Thus, in the second operation, the high pressure lubricating oil in the movable scroll's oil groove (83) or the fixed scroll's oil groove (80) can be fed sufficiently to the suction chamber (S1).

Further, the communicating groove (83*b*) of the movable scroll's oil groove (83) communicates, not with the compression chamber (S2), but with the suction chamber (S1), of the fluid chamber (S). This creates a relatively large difference between the internal pressure of the movable scroll's oil groove (83) or the fixed scroll's oil groove (80) and the pressure of the fluid chamber (S), thereby allowing a sufficient amount of the lubricating oil to be fed to the fluid chamber (S).

Moreover, the internal pressure of the movable scroll's oil groove (83) may be prevented from decreasing. Thus, the lubricating oil in the movable scroll's oil groove (83) can be fed to the thrust surfaces (sliding contact surfaces (A1, A2)) around the groove (83), and the key groove (46*b*).

<Third Operation>

Figure 5:
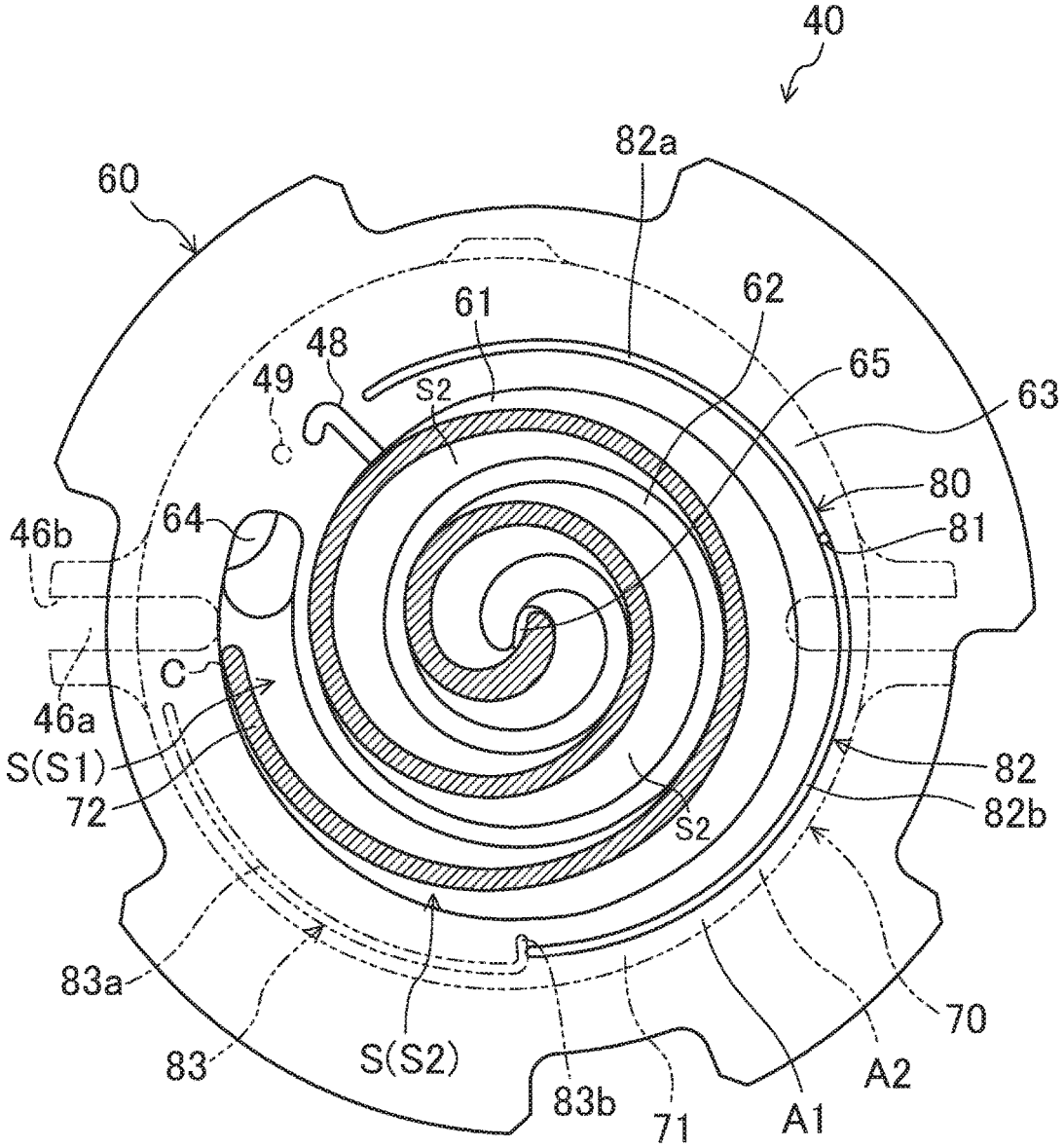
FIG. 5 is a bottom view of the fixed scroll of the scroll compressor according to the embodiment, illustrating a state where the fixed scroll is at an eccentric angular position where a third operation is performed.

When the movable scroll (70) at the eccentric angular position shown in FIG. 4 further rotates eccentrically to a different eccentric angular position shown in FIG. 5, for example, the third operation is performed. In the third operation, the communicating groove (83*b*) of the movable scroll's oil groove (83) is blocked from the suction chamber (S1). However, in the third operation, the movable scroll's oil groove (83) and the fixed scroll's oil groove (80) keep communicating with each other even after the second operation is finished.

If the communication between the movable scroll's oil groove (83) and the fixed scroll's oil groove (80) is maintained in this way, the movable scroll's oil groove (83) remains in a high pressure atmosphere. Therefore, also in the third operation, the lubricating oil in the movable scroll's oil groove (83) can be fed to the thrust surfaces (sliding contact surfaces (A1, A2)) around the groove (83), and the key groove (46*b*).

Moreover, in the third operation, the arcuate groove (83*a*) is adjacent to the contact (C) between the outer peripheral end of the wrap (72) of the movable scroll (70) and the inner peripheral surface of the outer peripheral wall (63) of the fixed scroll (60). That is, the other end of the arcuate groove (83*a*) is adjacent be contact (C) at the outer peripheral end of the movable scroll (70). Thus, part of the lubricating oil that has flowed from the arcuate groove (83*a*) onto the thrust surfaces is also fed to the contact (C) at the outer peripheral end of the movable scroll (70). This facilitates the lubrication of the contact (C), and allows a gap around the contact (C) to be sealed more effectively.

<Fourth Operation>

When the movable scroll (70) at the eccentric angular position shown in FIG. 5 further rotates eccentrically to a different eccentric angular position shown in FIG. 6, for example, the fourth operation is performed. In the fourth operation, the movable scroll's oil groove (83) is blocked from both of the fluid chamber (suction chamber (S1)) and the fixed scroll's oil groove (80). Thus, the feeding of the high pressure lubricating oil from the fixed scroll's oil groove (80) to the movable scroll's oil groove (83) is suspended. Specifically, the compression mechanism (40) intermittently suspends the feeding of the lubricating oil from the fixed scroll's oil groove (80) to the movable scroll (70) while the movable scroll (70) eccentrically rotates 360 degrees. Thus, continuous feeding of an excessive amount of the lubricating oil from the fixed scroll's oil groove (80) to the movable scroll's oil groove (83) may be prevented, thereby avoiding the lack of the lubricating oil in the oil sump (21) (i.e., avoiding the oil from being discharged outside).

After the fourth operation is finished, the first operation is performed again, and then the second, third, and fourth operations are sequentially performed.

-Advantages of Embodiment-

According to the embodiment described above, in the second operation, the movable scroll's oil groove (83) communicates with both of the fluid chamber (5) and the fixed scroll's oil groove (80). Thus, a sufficient difference can be made between the internal pressure of the movable scroll's oil groove (83) and the internal pressure of the fluid chamber (S). As a result, the lubricating oil in the movable scroll's oil groove (83) or the fixed scroll's oil groove (80) can be fed to the fluid chamber (S) with reliability, thereby further lubricating various sliding portions, and effectively sealing various portions to be sealed.

Also in the third operation after the second operation, the movable scroll's oil groove (83) keeps communicating with the fixed scroll's oil groove (80). This may effectively prevent the internal pressure of the movable scroll's oil groove (83) from decreasing, and allow the movable scroll's oil groove (83) to be replenished with the high pressure lubricating oil fed from the fixed scroll's oil groove (80). As a result, the area of the thrust surfaces lubricated by the lubricating oil fed from the fixed scroll's oil groove (80) and the movable scroll's oil groove (83) is increased with reliability.

Also in the fourth operation performed between the third and first operations, the movable scroll's oil groove (83) is blocked from the fixed scroll's oil groove (80). This may intermittently suspend the feeding of the lubricating oil from the fixed scroll's oil groove (80) to the movable scroll's oil groove (83). Thus, excessive feeding of the lubricating oil to the movable scroll's oil groove (83) may be prevented, thereby avoiding lack of the lubricating oil fed to the other sliding portions.

Since the movable scroll's oil groove (83) and the suction chamber (S1) communicate with each other, the difference between the pressure in the movable scroll's oil groove (83) and the pressure in the suction chamber (S1) may further be increased, thereby increasing the amount of the lubricating oil fed from the movable scroll's oil groove (83) to the suction chamber (S1).

The fixed scroll's oil groove (80) and the movable scroll's oil groove (83), both of which are arc-shaped, further increase the area of the thrust surfaces lubricated. In particular, the oil in the movable scroll's oil groove (83) can also be fed to the contact (C) at the outer peripheral end of the movable scroll (70). Thus, the portion around the contact (C) can be lubricated and sealed sufficiently. Further, part of the lubricating oil that has flowed from the arcuate groove (83*a*) of the movable scroll to the thrust surfaces can also be fed to the key groove (46*b*) and the contact (C) at the outer peripheral end of the movable scroll (70).

The communicating groove (83*b*) of the movable scroll's oil groove (83) extends in a direction toward the center of the movable scroll (70). In this configuration, the area of the communicating groove (83*b*) overlapping with the fluid chamber (S) hardly varies as compared with a configuration in which the communicating groove (83*b*) extends obliquely to the direction toward the center. As a result, in the second operation, a constant amount of oil can be stably fed to the fluid chamber (S) from the communicating groove (83*b*) of the movable scroll's oil groove (83). The amount of oil fed from the movable scroll's oil groove (83) to the fluid chamber (S) is generally determined based on the height of the communicating groove (83*b*) and the width in the circumferential direction of the communicating groove (83*b*). This reduces the number of parameters of the communicating groove (83*b*) on which the determination of the amount of oil fed to the fluid chamber (S) depends, thereby reducing variations in amount of oil, improving the compression efficiency, and substantially preventing the oil from being discharged outside.

-Alternative Examples of Embodiment-

Figure 8:
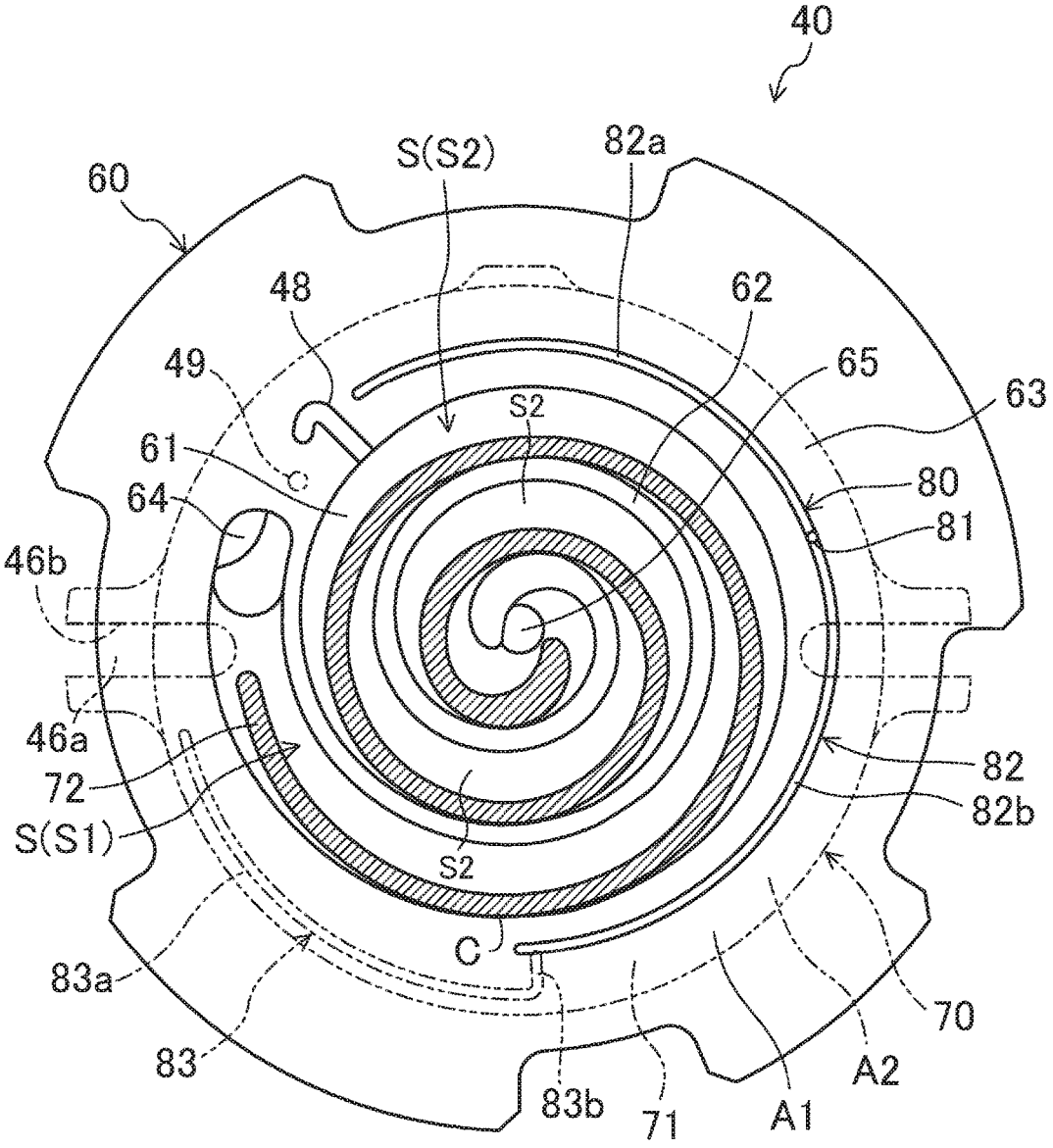
FIG. 8 is a view corresponding to FIG. 6, illustrating a scroll compressor according to an alternative example of the embodiment.
Figure 9:
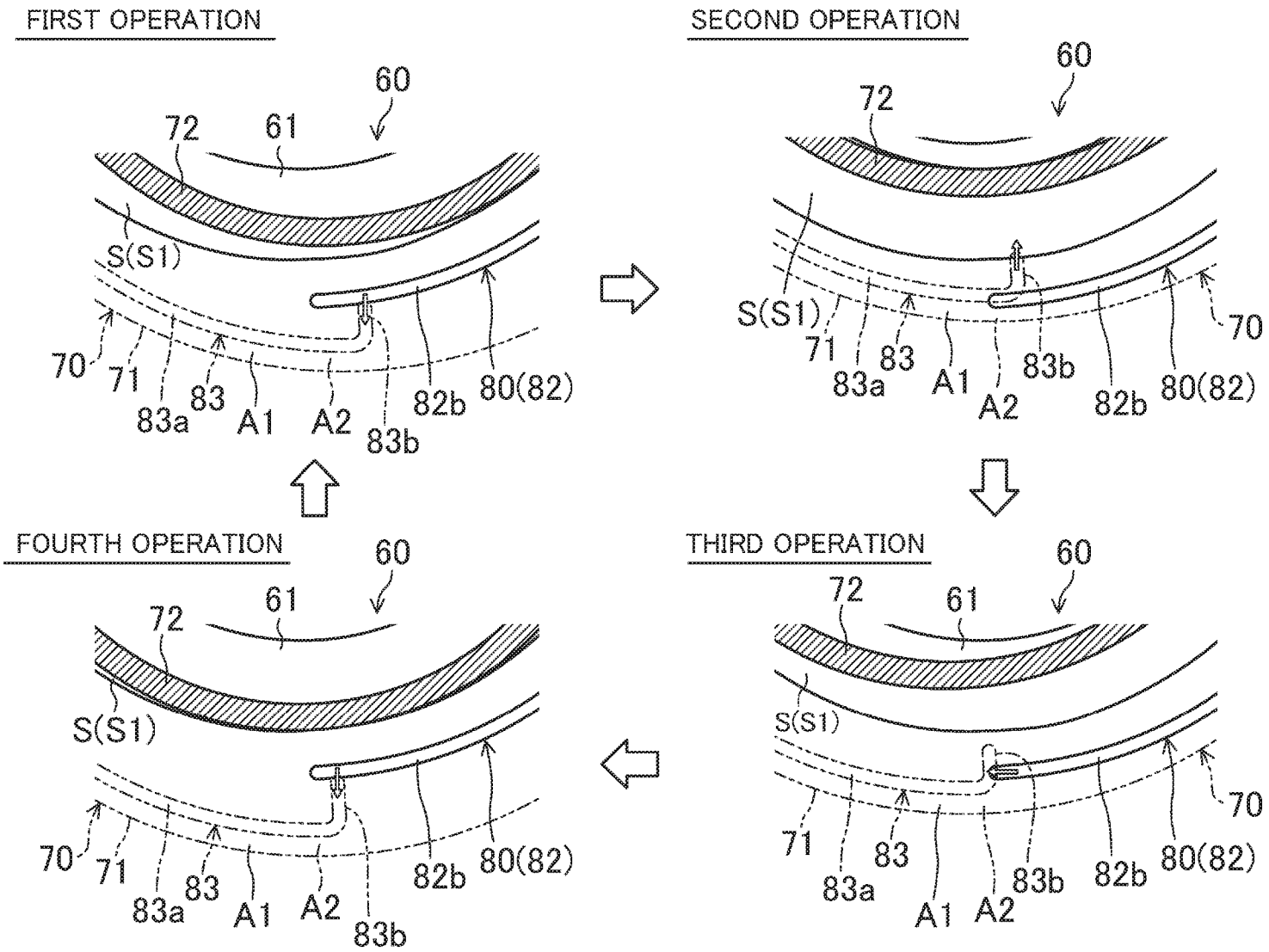
FIG. 9 is a view corresponding to FIG. 7, illustrating the scroll compressor according to the alternative example of the embodiment.

A scroll compressor (10) according to an alternative example shown in FIGS. 8 and 9 has a movable scroll's oil groove (83) with a configuration different from that of the above-described embodiment. The difference between the alternative example and the embodiment will be described below.

According to the alternative example, the communicating groove (83*b*) of the movable scroll's oil groove (83) is longer in a longitudinal direction (almost parallel to the radial direction of the movable scroll (70)) than the communicating groove (83*b*) of the above-described embodiment. Consequently, the fourth operation according to this alternative example differs from that of the above-described embodiment. In this alternative example, the first, second, and third operations are the same as those performed in the above-described embodiment, and thus, the advantages described above can also be obtained.

In the fourth operation in the above-described embodiment, the movable scroll's oil groove (83) is blocked from both of the fixed scroll's oil groove (80) and the fluid chamber (5). In contrast, in the fourth operation in the alternative example, the movable scroll's oil groove (83) and the fixed scroll's oil groove (80) keep communicating with each other. Specifically, according to the alternative example, the movable scroll's oil groove (83) and the fixed scroll's oil groove (80) keep communicating with each other in the third and fourth operations after the second operation.

Thus, a period during which the movable scroll's oil groove (83) communicates with the fixed scroll's oil groove (80) after the second operation is longer in the alternative example than in the above-described embodiment. This may effectively prevent the drop of the internal pressure of the movable scroll's oil groove (83), and allow the lubricating oil to be fed from the movable scroll's oil groove (83) to the thrust surfaces with reliability.

<Other Embodiments>

Figure 10:
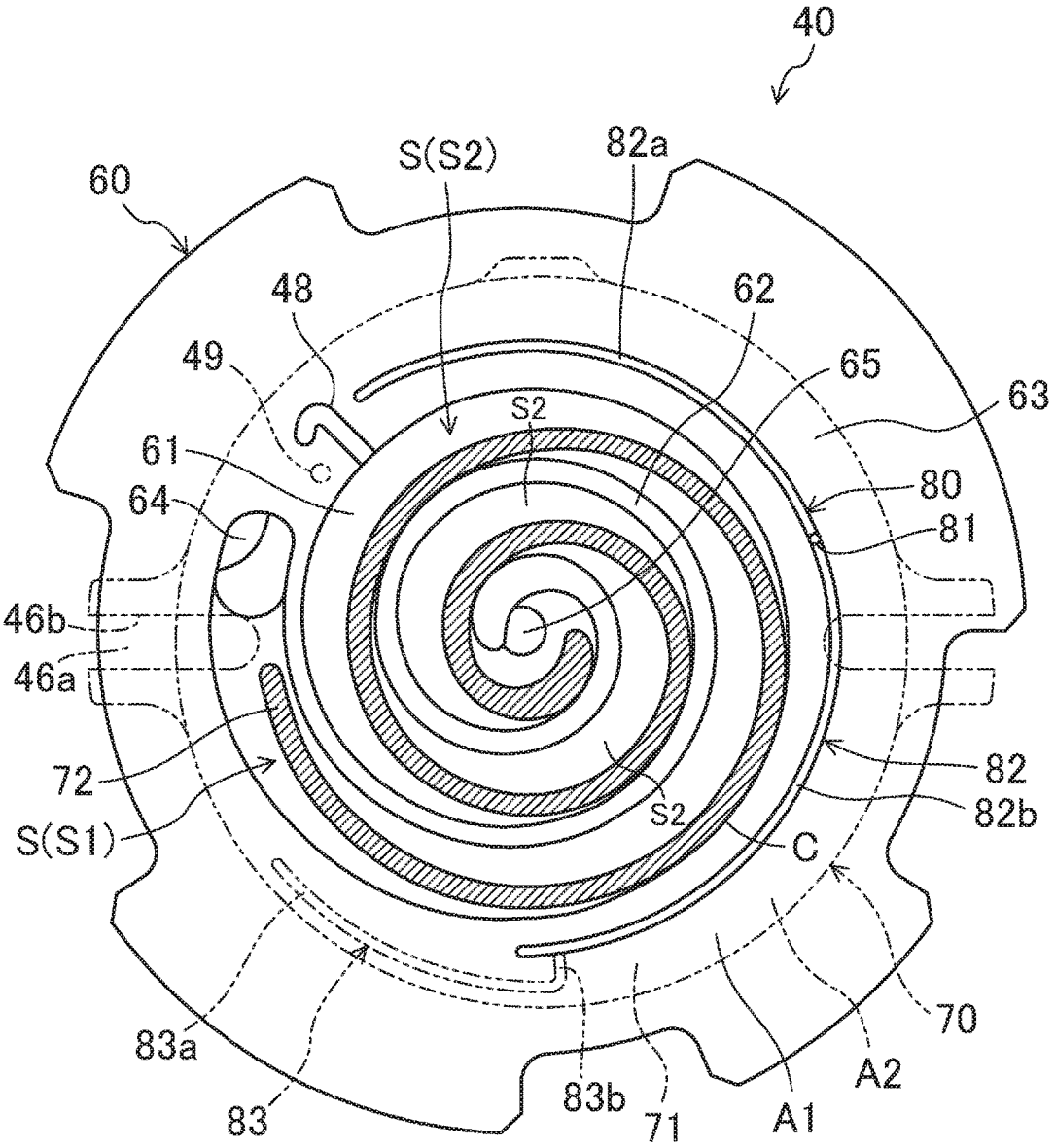
FIG. 10 is a view corresponding to FIG. 3, illustrating a scroll compressor according to another embodiment.

According to the above-described embodiment, the arcuate groove (83*a*) of the movable scroll is adjacent to the rear side of the key groove (46*b*), or the contact (C) at the outer peripheral end of the wrap (72) of the movable scroll (70) as shown in FIG. 5. However, as shown in for example FIG. 10, the arcuate groove (83*a*) does not necessarily extend to the position shown in FIG. 5, and may extend in an angular range of about 45 degrees, for example. Contrariwise, the arcuate groove (83*a*) may be longer than that of the above-described embodiment so as to overlap with the key groove (46*b*) in an axial direction.

The scroll compressor (10) is configured to compress a refrigerant in a refrigeration apparatus including a refrigerant circuit. However, the scroll compressor (10) is not limited to such a configuration, and may compress other fluid.

The shape of the movable scroll's oil groove (83) is not limited to the one described in the embodiment. Specifically, the movable scroll's oil groove (83) may have any shape as long as the movable scroll's oil groove (83) can communicate with both of the fluid chamber (S) and the fixed scroll's oil groove (80).

INDUSTRIAL APPLICABILITY

As can be seen from the foregoing, the present invention is useful as a scroll compressor.

What is claimed is:

1. A scroll compressor, comprising a compression mechanism including a fixed scroll having a fixed end plate, an outer peripheral wall standing on an outer edge of the fixed end plate, and a fixed wrap standing inside the outer peripheral wall, and a movable scroll having a movable end plate in sliding contact with tip ends of the fixed wrap and the outer peripheral wall of the fixed scroll, and a movable wrap standing on the movable end plate, the compression mechanism forming a fluid chamber between the fixed scroll and the movable scroll, a fixed scroll oil groove being formed in a fixed sliding contact surface of the outer peripheral wall of the fixed scroll on which the movable end plate of the movable scroll slides, lubricating oil having a high pressure corresponding to a discharge pressure of the compression mechanism being fed into the fixed scroll oil groove, a movable scroll oil groove being formed in a movable sliding contact surface of the movable scroll, which slides on the outer peripheral wall of the fixed scroll, and the compression mechanism performing a first operation in which the fixed scroll oil groove and the movable scroll oil groove communicate with each other without the fixed scroll oil groove and the movable scroll oil groove communicating with the fluid chamber, and a second operation in which, after the first operation, the movable scroll oil groove simultaneously communicating with both of the fixed scroll oil groove and the fluid chamber.

2. The scroll compressor of claim 1, wherein the compression mechanism performs, after the second operation, a third operation in which the movable scroll oil groove is blocked from the fluid chamber, and the fixed scroll oil groove and the movable scroll oil groove keep communicating with each other.

3. The scroll compressor of claim 2, wherein the compression mechanism performs, after the third operation and before the first operation, a fourth operation in which the movable scroll oil groove is simultaneously blocked from both of the fixed scroll oil groove and the fluid chamber.

4. The scroll compressor of claim 3, wherein the compression mechanism divides the fluid chamber into a suction chamber and a compression chamber with a contact interposed between the suction chamber and the compression chamber, with an inner peripheral surface of the outer peripheral wall of the fixed scroll being in contact with an outer peripheral surface of the movable wrap of the movable scroll at the contact, and the movable scroll oil groove simultaneously communicates with both of the fixed scroll oil groove and the suction chamber in the second operation.

5. The scroll compressor of claim 3, wherein the movable scroll oil groove includes an arcuate groove that is arc-shaped and extends along an inner peripheral surface of the outer peripheral wall of the fixed scroll.

6. The scroll compressor of claim 2, wherein the compression mechanism divides the fluid chamber into a suction chamber and a compression chamber with a contact interposed between the suction chamber and the compression chamber, with an inner peripheral surface of the outer peripheral wall of the fixed scroll being in contact with an outer peripheral surface of the movable wrap of the movable scroll at the contact, and the movable scroll oil groove simultaneously communicates with both of the fixed scroll oil groove and the suction chamber in the second operation.

7. The scroll compressor of claim 2, wherein the movable scroll oil groove includes an arcuate groove that is arc-shaped and extends along an inner peripheral surface of the outer peripheral wall of the fixed scroll.

8. The scroll compressor of claim 1, wherein the compression mechanism divides the fluid chamber into a suction chamber and a compression chamber with a contact interposed between the suction chamber and the compression chamber, with an inner peripheral surface of the outer peripheral wall of the fixed scroll being in contact with an outer peripheral surface of the movable wrap of the movable scroll at the contact, and the movable scroll oil groove simultaneously communicates with both of the fixed scroll oil groove and the suction chamber in the second operation.

9. The scroll compressor of claim 8, wherein the movable scroll oil groove includes an arcuate groove that is arc-shaped and extends along an inner peripheral surface of the outer peripheral wall of the fixed scroll.

10. The scroll compressor of claim 1, wherein the movable scroll oil groove includes an arcuate groove that is arc-shaped and extends along an inner peripheral surface of the outer peripheral wall of the fixed scroll.

11. The scroll compressor of claim 10, wherein the compression mechanism divides the fluid chamber into a suction chamber and a compression chamber with a contact interposed between the suction chamber and the compression chamber when the wrap of the movable scroll comes to a predetermined eccentric angular position, with an outer peripheral end of the movable wrap of the movable scroll being in contact with an inner peripheral surface of the outer peripheral wall of the fixed scroll at the contact, and a portion of the arcuate groove of the movable scroll oil groove is adjacent to the contact of the outer peripheral end of the movable wrap of the movable scroll when the movable scroll is at the predetermined eccentric angular position.

12. The scroll compressor of claim 11, wherein the compression mechanism includes a key groove formed in the movable scroll and into which a key of an Oldham coupling fits, a portion of the arcuate groove of the movable scroll oil groove is adjacent to a rear side of the key groove when at least the movable scroll is at a predetermined eccentric angular position.

13. The scroll compressor of claim 11, wherein the movable scroll oil groove includes a communicating groove extending from the arcuate groove toward a center of the movable scroll and communicates with the fluid chamber in the second operation.

14. The scroll compressor of claim 10, wherein the compression mechanism includes a key groove formed in the movable scroll and into which a key of an Oldham coupling fits, a portion of the arcuate groove of the movable scroll oil groove is adjacent to a rear side of the key groove when at least the movable scroll is at a predetermined eccentric angular position.

15. The scroll compressor of claim 14, wherein the movable scroll oil groove includes a communicating groove extending from the arcuate groove toward a center of the movable scroll and communicates with the fluid chamber in the second operation.

16. The scroll compressor of claim 10, wherein the movable scroll oil groove includes a communicating groove extending from the arcuate groove toward a center of the movable scroll and communicates with the fluid chamber in the second operation.

* * * * *